United States Patent [19]

Frantzen

[11] 4,174,264

[45] Nov. 13, 1979

[54] TELEVISION SHADOW MASK AND METHOD OF MAKING SAME

[75] Inventor: John J. Frantzen, White Bear Lake, Minn.

[73] Assignee: Neil B. Schulte, North Oaks, Minn. ; a part interest

[21] Appl. No.: 933,108

[22] Filed: Aug. 11, 1978

[51] Int. Cl.[2] ..... C25D 1/08; H01J 29/80

[52] U.S. Cl. ..... 204/11; 313/403

[58] Field of Search ..... 204/11, 3, 4, 35 R; 313/403

[56] References Cited

U.S. PATENT DOCUMENTS

| | | | |
|---|---|---|---|
| 3,046,202 | 7/1962 | Horner et al. | 204/11 |
| 3,763,030 | 10/1973 | Zimmer | 204/11 |
| 3,900,359 | 8/1975 | Bakewell | 204/11 |
| 4,094,678 | 6/1978 | Palac | 96/36.1 |

*Primary Examiner*—T. M. Tufariello

*Attorney, Agent, or Firm*—Neil B. Schulte

[57] ABSTRACT

A color television shadow mask is constructed by electroforming metal onto a mask shaped base plate having a suitable resist pattern thereon.

2 Claims, 12 Drawing Figures

TELEVISION SHADOW MASK AND METHOD OF MAKING SAME

BACKGROUND OF THE INVENTION

In the prior art, color television shadow masks are used inside picture tubes immediately adjacent the front surface to ensure that the electron beams fall precisely on the desired phosphor dots to create a sharp picture. As the design of color television picture tubes has become more sophisticated and exacting, greater demands have been made on the performance of the shadow mask. However, the prior art procedure for producing a shadow mask is simply incapable of meeting these demands in an adequate manner and the result has been a large percentage of rejections in the finished masks. This means a loss not only of the finished shadow mask but also its associated picture tube face plate since the phosphor pattern in the tube is produced from one individual mask which must accompany the picture tube along the entire assembly line.

The prior art method for producing shadow masks comprises the use of cold rolled sheet steel which is covered with a resist material to protect and save the desired metallic areas. A pattern of holes is left exposed and removed with an acid spray so that a very delicate and almost transparent sheet of metal remains. This delicate sheet of metal must then be drawn and formed into the shape of the front of a picture tube and then annealed to relieve stresses. The forming process yields unpredictable results and distorts the hole pattern in a unique way each time. Accordingly, to ensure that the phosphor dots on the face of the picture tube are in the correct positions relative to the shadow mask, the phosphor is applied to the picture tube with a light activation process that employs the shadow mask itself. Each of the three colors of phosphor must be applied separately requiring the shadow mask to be mounted and unmounted from the picture tube three times. Thereafter the shadow mask must accompany the picture tube throughout the manufacturing process because only the shadow mask that was used to establish the phosphor dots will be suitable to direct the electron beams properly onto the phosphor dots during operation. Thus, if a defect shows up in the shadow mask it must be rejected and the picture tube face plate that was manufactured from it is rejected as well.

There are numerous reasons why defects show up in the prior art shadow masks. The steel sheet that is used is often nonuniform in thickness and may have impurities that show up as luter lines only after the shaping and annealing steps have been completed. Since the etched steel is fragile, it is often deformed in the shaping process causing the dot pattern to be displaced an unacceptable distance. The holes or slots are irregular in size in many cases and the mask can tear during the shaping process. Also, as is the nature of steel, it will spring back slightly from the forming position in an unpredictable amount causing variations in size and shape.

The prior art annealing process is fraught with difficulties in that oil canning often results producing ripples and buckling in the surface of the mask. Creating holes by etching with acid is not the best approach since it necessarily entails rounded corners in the holes and irregular edges. This causes poor fidelity in the television picture as a result of poor definition of the electron beam by the shadow mask. All of these problems lead to an unacceptably high rejection rate which causes large cost increases in the production of television picture tubes. My invention, however, overcomes all of these problems with an entirely new and novel approach to the production of shadow masks.

SUMMARY OF THE INVENTION

In brief, my invention involves the production of shadow masks through a process of electroforming. Pure ductile iron is electrically deposited onto a suitable base so as to create by electroforming the portions of the mask which are desired rather than to etch away the holes as is the case with the prior art. Three separate processes are possible using my invention. In one embodiment a suitable base plate is covered with the resist pattern which leaves exposed areas upon which metal can be deposited to form the mask. The base is then shaped into the form of a shadow mask and inspected to ensure that it is dimensionally correct and properly shaped. This master base may then be immersed in an electroforming bath with iron anodes. The passage of electric current will cause iron molecules to be deposited on the exposed areas of the master to form a perfect shadow mask. The mask can then be stripped off in a completed state. Hundreds of masks can be made from the same master base plate and all of them will be exactly identical. This allows total interchangeability between shadow masks and picture tubes. Thus, if a shadow mask is damaged during manufacture its corresponding picture tube need not be rejected. Another identical and interchangeable shadow mask can simply be substituted for the damaged mask.

Other embodiments involve forming the base plate first in the shape of the shadow mask and then applying the resist pattern to the formed base through the use of a light activated resist and suitable light lenses. Such lenses are well known to those skilled in the art.

Still another embodiment is possible in that the mask can be electrodeposited on a flat base plate having a suitable resist pattern. Electroformed iron can be made so pure, ductile, and free from defects that it can be easily shaped into the configuration of a shadow mask after the formation without being subject to the prior art disadvantages of stretching, deformation, tears, spring back, or the problems associated with the annealing process.

It may therefore be seen that it is an object of my invention to provide a completely improved color television shadow mask. It is a further object of my invention to provide an improved process for producing a shadow mask. Further objects and advantages will become apparent upon consideration of the following detailed description and drawings.

DESCRIPTION OF THE PREFERRED EMBODIMENT

Figure 1:
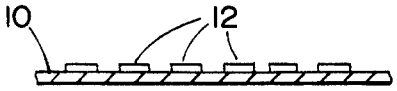
FIGS. 1, 2, 3, and 4 show sectional views illustrating the consecutive steps in the process of producing the new shadow mask of my invention.
Figure 2:
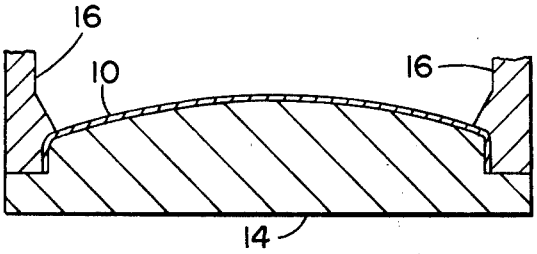
Figure 3:
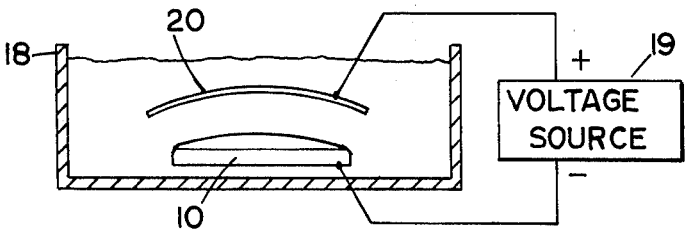
Figure 4:
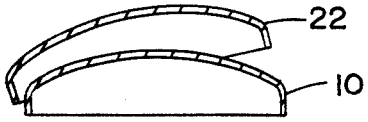

In FIG. 1 a base plate 10 with a resist pattern 12 thereon is shown. The base may comprise a copper or brass plate with a nickel release layer on the surface. The nickel layer provides a smooth surface upon which to deposit the iron that forms the mask and from which it will be easy to strip the completed mask. The copper or brass base plate ensures easy and reliable formability of the base. As shown in FIG. 2, the base 10, with the resist pattern thereon, is drawn down with a two part die having a forming surface 14 and a compression member 16. The base 10 is thereby formed into the shape of the desired shadow mask. The easily formed copper or brass base plate 10 is much thicker and stronger than the thin steel used in shadow mask production in the prior art. Thus, there is no deformation of the resist pattern or dimensional variations as found in the prior art. However, if some defect is present, it can be detected by inspection at this point in the process so that no picture tubes or shadow masks are jeopardized. The inspected base 10 is then immersed in an electroforming bath 18 as shown in FIG. 3. A voltage source 19 delivers electric current through an iron anode 20. Ions of iron migrate through the solution in the bath and are deposited on the exposed areas of the base 10. Although iron is used in the preferred embodiment, the mask could also be formed from deposited copper, copper alloys, or other suitable metals. When the shadow mask is built up to the desired uniform thickness the mask 22 is stripped off the base 10 as shown in FIG. 4.

The characteristics of mask 22 are much superior to those of the prior art shadow masks. Mask 22 has been electrodeposited from pure iron and therefore has no impurities such as are found in cold rolled steel. Perfect uniformity of grain structure ensures even mechanical characteristics throughout the mask. There are no stresses left over from rolling, forming, or annealing. Thus there are no problems with oil canning or buckling and, of course, no spring back problems. Every mask 22 that is produced from base 10 will be identical to and interchangeable with any other mask. Since mask 22 is already in the exact desired shape it does not have to go through a deformation process. Thus, it can be made of much thinner metal which means that the slots will be much sharper and better defined, creating a better picture in the television set. In the prior art, shadow masks are made thicker simply to have the physical strength to resist the shaping deformation mentioned earlier.

Figure 5:
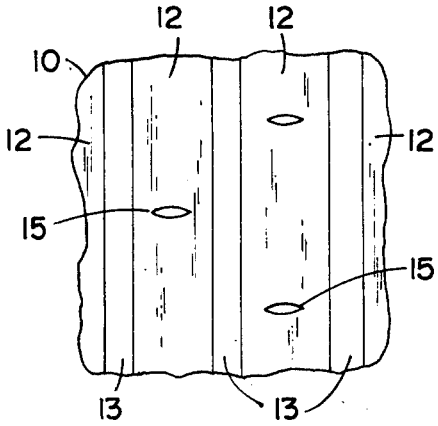
FIG. 5 shows a possible resist pattern to be used on the base in producing the new shadow mask.
Figure 6:
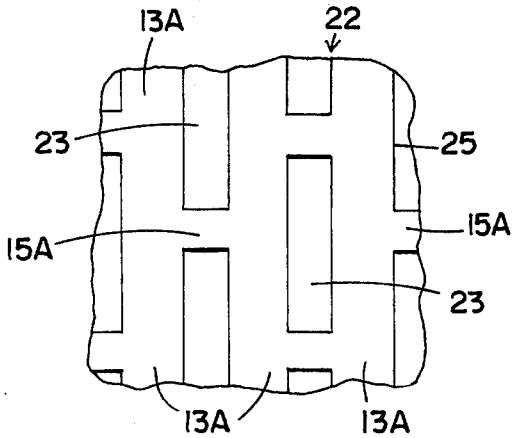
FIG. 6 shows the resulting electroformed shadow mask in a fragmentary view.
Figure 9:
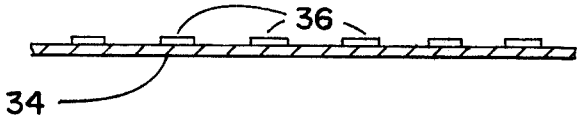
FIGS. 9, 10, 11, and 12 show subsequent steps in another embodiment of the invention wherein the mask is electroformed in a flat state and then formed to create a shadow mask.
Figure 10:
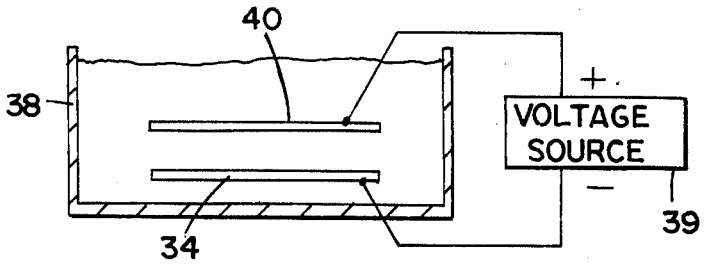

FIG. 5 shows a fragmentary portion of the base plate 10 with the resist pattern thereon. The resist is applied in the areas designated 12 in FIG. 5 so as to leave exposed areas in the form of parallel bars 13 with small elongated islands 15 therebetween. As the mask is electroformed in bath 18 the iron will deposit on the exposed areas 13 and 15 spreading upwards and outwards over the resist to join with the elongated islands to create a complete structure. In FIG. 6 a fragmentary portion of the completed shadow mask is shown. The metal deposited on the exposed areas 13 will grow to create the generally parallel bars 13A shown in FIG. 6. The metal deposited on the small elongated island areas 15 will expand to form the tie bars 15A in FIG. 6 leaving rectangular apertures 23 as shown.

Figure 7:
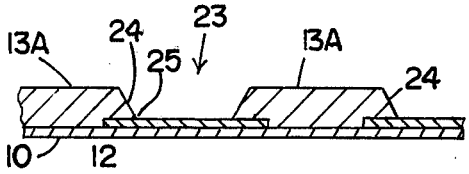
FIG. 7 is a fragmentary sectional enlarged view of the electroformed shadow mask.

Slot shaped apertures are the most commonly used openings in shadow masks today although other shapes and sizes would be equally possible by changing the resist pattern accordingly. It is important to note that this process produces very sharp corners and edges in the slots 23. Referring to FIG. 7 it will be seen that the electrodeposited strips 13A grow up and outward from the openings 13 on base 10 advancing in a very predictable and controlled way to create a sharp rectangular opening 23 with very sharp well defined edges 25. Prior art etching processes cause severe roundness in the corners of the slot. My invention, however, creates square well defined corners as shown in FIG. 6. The angle of beveled surfaces 24 can be adjusted by proper adjustment of the shape of the resist pattern, by adjustment of the anodes, and careful control of the plating current density. This angle is important to the mask to provide adequate electron beam clearance.

Theoretically it is possible to create a shadow mask in which the slots 23 are continuous, separated only by strips of metal 13A. In the prior art the tie bars 15A are utilized primarily to give the mask structural strength and to prevent deformation during the manufacturing process. With the present invention the number of tie bars 15A could be reduced drastically since they are not needed to resist deformation. It is also possible to control the rate of metal deposition in different areas of the mask so that the slots 23 can vary in size from the center of the picture tube to the perimeter. This could be done simply by controlling the size and position of electrodes 20 or by using blocking screens in electroforming bath 18 to hinder the migration of ions through the solution in a manner well known to those skilled in the art. It is generally much easier with the present invention to control the size, width, and shape of the slots since the deposited metal is pure and predictable in behavior and we do not have to contend with variations of metal thickness or grain structures or impurities as is the case with the prior art.

Figure 8:
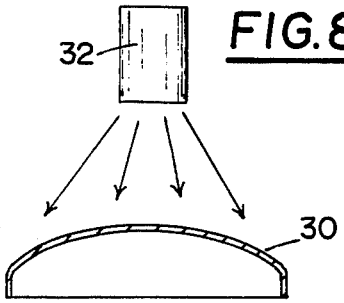
FIG. 8 demonstrates another embodiment of the invention in which the base plate is formed first and the resist pattern applied later.

A second embodiment of the invention is illustrated in FIG. 8. In this variation the base plate 30 would first be shaped into a shadow mask configuration by suitable dies in a manner similar to that shown in FIG. 2. A light activated resist would be applied to the surface of the shaped base and cured with a photographic image projected through a suitable lens system 32. Such lens systems are known in the art. This approach ensures that the resist pattern will not be damaged during the formation of the base. The rest of the production of the mask would involve steps similar to those shown in FIGS. 3 and 4.

Figure 11:
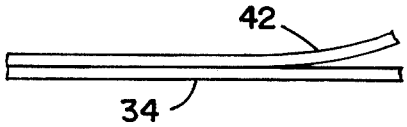
Figure 12:
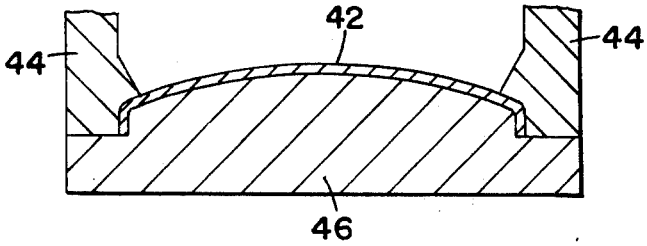

Still another variation in the process is shown in FIGS. 9 through 12. A base plate 34, again constructed from brass or copper with a nickel release layer, would have a suitable resist pattern 36 applied to it. The flat plate 34 would then be immersed in an electroforming bath 38 with suitable iron anodes 40 and a voltage source 39. The electroformed flat mask 42 would be stripped from base 34 as shown in FIG. 11 and then shaped into a shadow mask by suitable dies 44 and 46 as shown in FIG. 12. Since electroformed metal is very pure and very uniform in thickness it can be easily formed as shown in FIG. 12 without fear of tearing or distortion of the hole pattern. Electroformed iron is very ductile and formable and lacks any of the stresses and impurities associated with cold rolled steel. There is negligible spring back from this type of forming operation.

Clearly there are many variations on my invention, all of which are made possible by the electroforming approach proposed herein. The exact sequence of steps or the precise arrangement of the resist pattern are not essential to the spirit and scope of the invention. Accordingly, I intend to be bound only to the appended claims.

I claim:

1. A color television shadow mask constructed of electrodeposited metal formed on a base having a suitable resist pattern to produce a hole pattern, said hole pattern created by strips of metal between rows of holes and tie bars connecting said strips, said resist pattern comprising a layer of resist with openings therein to create exposed areas, said exposed areas comprising parallel bars with small elongated islands therebetween, said strips of the mask formed on the parallel bar areas and said tie bars formed on the elongated island areas.

2. A process for producing color television shadow masks wherein the mask is electroformed in an electroforming bath on a base plate having a resist pattern thereon with exposed areas designed to allow deposition of metal to form the mask said hole pattern formed by strips of metal, said strips connected together by tie bars, said resist pattern comprising a layer of resist with openings therein to create exposed areas, which exposed areas comprise parallel bars with small elongated islands therebetween, said strips of the mask formed on the parallel bar areas and said tie bars formed on the elongated island areas.

* * * * *